US010215041B2

(12) United States Patent
Barz et al.

(10) Patent No.: US 10,215,041 B2
(45) Date of Patent: Feb. 26, 2019

(54) SEALING RING SEGMENT FOR A STATOR OF A TURBINE

(71) Applicant: Siemens Aktiengesellschaft, Munich (DE)

(72) Inventors: Thorsten Barz, Berlin (DE); Roland Habel, Bergisch Gladbach (DE); Sebastian Stupariu-Cohan, Mettmann (DE)

(73) Assignee: Siemens Aktiengesellschaft, Munich (DE)

( * ) Notice: Subject to any disclaimer, the term of this patent is extended or adjusted under 35 U.S.C. 154(b) by 328 days.

(21) Appl. No.: 14/898,135

(22) PCT Filed: Jun. 25, 2014

(86) PCT No.: PCT/EP2014/063432
§ 371 (c)(1),
(2) Date: Dec. 13, 2015

(87) PCT Pub. No.: WO2014/207058
PCT Pub. Date: Dec. 31, 2014

(65) Prior Publication Data

US 2016/0208630 A1 Jul. 21, 2016

(30) Foreign Application Priority Data

Jun. 28, 2013 (EP) ..... 13174357

(51) Int. Cl.
*F01D 9/04* (2006.01)
*F01D 11/00* (2006.01)

(52) U.S. Cl.
CPC ..... *F01D 9/042* (2013.01); *F01D 11/001* (2013.01); *F05D 2240/80* (2013.01); *F05D 2260/30* (2013.01)

(58) Field of Classification Search
CPC . F01D 9/04; F01D 9/042; F01D 11/00; F01D 11/001; F05D 2260/30; F05D 2240/80
See application file for complete search history.

(56) References Cited

U.S. PATENT DOCUMENTS 3,501,246 A 3/1970 Hickey
4,576,548 A 3/1986 Smed et al.
(Continued)

FOREIGN PATENT DOCUMENTS

CN 101067384 A 11/2007
CN 101087969 A 12/2007
(Continued)

OTHER PUBLICATIONS

JP Notice of Allowance dated Nov. 21, 2016, for JP patent application No. 2016-522477.
(Continued)

*Primary Examiner* — Logan Kraft
*Assistant Examiner* — Elton Wong
(74) *Attorney, Agent, or Firm* — Beusse Wolter Sanks & Maire

(57) ABSTRACT

A sealing ring segment for a stator of a turbine, the sealing ring segment has substantially the shape of a cylinder casing segment and has on its outer side a groove for fixing a plurality of guide vanes. The sealing ring segment has, for each guide vane that is fixable to the sealing ring segment, at least one pressure bolt that acts on the respective guide vane by a restoring force, the pressure bolt being able to be fixed and accordingly oriented by a corresponding opening in the sealing ring segment and being configured as a cylindrical element which can be compressed in the axial direction, and wherein the respective pressure bolt has a disk spring and the restoring force of the respective pressure bolt
(Continued)

acts in the radial direction with respect to the rotation axis of the turbine in which the sealing ring segment is placed.

17 Claims, 3 Drawing Sheets

(56) References Cited

U.S. PATENT DOCUMENTS

| | | | | |
|---|---|---|---|---|
| 4,897,021 | A | 1/1990 | Chaplin et al. | |
| 5,635,785 | A | 6/1997 | Schwanda et al. | |
| 7,645,117 | B2 | 1/2010 | Bracken et al. | |
| 2007/0177973 | A1* | 8/2007 | Seki | F01D 5/225 415/191 |
| 2007/0258826 | A1 | 11/2007 | Bracken et al. | |
| 2008/0008579 | A1 | 1/2008 | Mikulec | |
| 2008/0019836 | A1 | 1/2008 | Butz et al. | |
| 2010/0031672 | A1* | 2/2010 | Ichiryu | F01D 25/28 60/796 |
| 2011/0135479 | A1* | 6/2011 | Ueda | F01D 5/16 416/179 |
| 2012/0286476 | A1* | 11/2012 | Samudrala | F01D 11/001 277/301 |

FOREIGN PATENT DOCUMENTS

| | | | | |
|---|---|---|---|---|
| CN | 102132047 | A | 7/2011 | |
| EP | 1441108 | A2 | 7/2004 | |
| EP | 1441108 | B1 | 3/2011 | |
| GB | 142924 | A * | 5/1920 | B32B 29/03446 |
| JP | S60159306 | A | 8/1985 | |
| JP | H0223204 | A | 1/1990 | |
| JP | 2010151044 | A | 7/2010 | |
| RU | 2174278 | C2 | 9/2001 | |

OTHER PUBLICATIONS

RU Search Report dated Apr. 3, 2018, for RU patent application No. 2016102766.

* cited by examiner

SEALING RING SEGMENT FOR A STATOR OF A TURBINE

CROSS REFERENCE TO RELATED APPLICATIONS

This application is the US National Stage of International Application No. PCT/EP2014/063432 filed Jun. 25, 2014, and claims the benefit thereof. The International Application claims the benefit of European Application No. EP13174357 filed Jun. 28, 2013. All of the applications are incorporated by reference herein in their entirety.

FIELD OF INVENTION

The invention relates to a sealing ring segment for a stator of a turbine, said sealing ring segment having substantially the shape of a cylinder casing segment and having on its outer side a groove for fixing a plurality of guide vanes.

BACKGROUND OF INVENTION

A turbine is a turbomachine which converts the internal energy (enthalpy) of a flowing fluid (liquid or gas) into rotational energy and ultimately into mechanical drive energy. A part of the internal energy of the fluid flow is extracted therefrom by the laminar flow, which is as swirl-free as possible, around the turbine blades, said part of the internal energy being transferred to the rotor blades of the turbine. Via the latter, the turbine shaft is then set into rotation, and the useful power is transmitted to a coupled working machine, for example to a generator. The rotor blades and the shaft are part of the movable rotor of the turbine, said rotor being arranged within a housing.

As a rule, a plurality of blades are mounted on the shaft. Rotor blades mounted in a plane each form a blade wheel or rotor wheel. The blades are profiled in a slightly curved manner, similarly to an airplane wing. Upstream of each rotor wheel there is usually a stator wheel. These guide vanes project from the housing into the flowing medium and cause it to swirl. The swirl (kinetic energy) generated in the stator wheel is used in the subsequent rotor wheel in order to set the shaft, on which the rotor wheel blades are mounted, into rotation.

The stator wheel and rotor wheel together are designated a stage. Often, a plurality of such stages are connected in series. Since the stator wheel is stationary, and the guide vanes are fastened to the outside of the housing, a seal with respect to the shaft of the rotor wheel has to be established, in order to keep losses as low as possible.

To this end, the guide vanes are held on the rotor-side by sealing rings in the form of a cylinder casing. Said sealing rings usually consist of a plurality of segments, usually ten. These are pushed onto a hook connector at the head of the guide vanes (tongue-and-groove connection) and in this way seal off the hot-gas duct from the rotor. In order to prevent displacement in the circumferential direction, the sealing ring segments are fixed individually by bolts which each project radially into one of the guide vanes.

On account of given tolerances between blades and sealing rings, said tolerances being necessary for the thermal expansion that is normal in operation, relative movement is possible. In this case, it has been shown that, as a result of dynamic excitations, considerable wear can arise on the sealing ring segments. The findings extend here from simple wear, which makes replacement during scheduled maintenance necessary, to massive wear, which can result in forced maintenance involving replacement of the sealing ring or can also result in turbine damage involving blade damage.

It is known practice here to provide the sealing ring segment with elastic elements that act on the guide vanes by means of a restoring force. Extensive disk springs are arranged for this purpose in U.S. Pat. No. 7,645,117, and leaf springs, which have a curvature or wave shape in the azimuthal or axial direction, such that the corresponding pretension arises, are used in US 2008/0019836, US 2011/0135479 and EP 1 441 108.

However, a disadvantage with the known sealing ring segments is that, when leaf or large disk springs are used, extensive pretension is always applied to a plurality of guide vanes. This makes it difficult to mount the guide vanes. In addition, the strength of the restoring force is not individually settable or re-adjustable.

SUMMARY OF INVENTION

It is therefore an object of the invention to specify a sealing ring segment of the type mentioned at the beginning, which has a longer service life and allows less outlay on repairs for a turbine, with simple mounting and a high optimization capability.

According to aspects of the invention, this object is achieved in that the sealing ring segment has, for each guide vane that is fixable to the sealing ring segment, in each case at least one pressure bolt that acts on the respective guide vane by means of a restoring force, said pressure bolt being configured as a cylindrical element which can be compressed in the axial direction.

The invention proceeds here from the consideration that the service life of the turbine could be increased and the outlay on repairs for the turbine could be reduced if the wear could be reduced by the relative movement of individual guide vanes and the sealing ring segment. To this end, the relative movement would have to be limited. However, consideration has to be shown for the thermal expansion during operation, thereby ruling out fixing in a fixed form-fitting manner. A remedy for this is fixing in a force-fitting manner by means of a pressure bolt which, by way of its restoring force, ensures that the guide vane is fixed in a force-fitting manner, while thermal expansion remains possible on account of the elasticity. A pressure bolt is a substantially cylindrical element which can be compressed in the axial direction, for example by an internal structure of the piston type. In this case, the pressure bolt is configured in a self-restoring manner for example by a corresponding spring arrangement. The pressure bolt can be fixed and accordingly oriented by a corresponding opening in the sealing ring segment. In this case, for each guide vane that is fixable to the sealing ring segment, in each case at least one pressure bolt that acts on the respective guide vane by means of a restoring force is provided. As a result, the sealing ring segment is fixed in a particularly secure manner, since a force-fitting connection is produced by a pressure bolt with each individual guide vane. Therefore, none of the guide vanes can execute a relative movement producing wear.

In an advantageous configuration of the sealing ring segment, the groove for fixing the guide vanes advantageously extends in the circumferential direction. The restoring force of the respective elastic element acts in the radial direction. This allows easy mounting of the sealing ring segment, which can be pushed easily onto the hook connector of the guide vanes. As a result of the radial orientation of the elastic element, the latter can be pretensioned from the inside after the insertion of the sealing ring.

The respective elastic element, in particular the pressure bolt, comprises a disk spring. A disk spring is understood to be a conical annular shell which is loadable in the axial direction and in this way can be (dynamically) stressed both at rest and when oscillating. The introduction of force normally takes place via the upper inner periphery and the lower outer periphery. The disk spring can in this case be used as a single spring or as a spring column. In a column, either individual disk springs or spring packs that consist of a plurality of springs can be layered alternately. Compared with other types of spring, the disk spring has a number of advantageous properties, for instance it can absorb very large forces in a small installation space. Its spring characteristic can be linear or degressive, depending on dimensional relationships, and can also be configured in a progressive (rising) manner by way of a suitable arrangement. As a result of there being almost any desired possible combinations of individual disk springs, the characteristic can be varied within wide ranges by way of the column length. With correct dimensioning, the disk spring has a long service life with dynamic loading, as occurs for example in a turbine. Spring steels, including stainless and heat-resisting steels, and also copper alloys (CuSn 8, CuBe 2) and nickel alloys (Nimonic, Iconel, Duratherm) are suitable materials.

Furthermore, the respective elastic element, in particular the pressure bolt, is fixed to the sealing ring segment by means of a screw connection. This results on the one hand in a releasable connection which thus allows subsequent replacement during maintenance, and on the other hand allows easy mounting. Furthermore, as a result of the depth of screwing in, the restoring force onto the hook connector of the guide vane is set precisely. In order to prevent the bolt from releasing during operation of the turbine, provision is made here of an anti-rotation means, for example by way of an anti-rotation bolt that hooks in laterally.

In an additionally advantageous configuration, the respective elastic element for circumferentially fixing the sealing ring segment is arranged such that it fixes the respective guide vane in a force-fitting manner in the circumferential direction. To this end, the guide vane has a corresponding depression into which the correspondingly embodied elastic element is introduced. As a result, the elastic element, in particular the pressure bolt, as a kind of double use, also assumes the role of the circumferential fixing bolt used hitherto.

In a stator for a turbine having a number of guide vanes, a plurality of the guide vanes are advantageously arranged at their radially inwardly directed head, by means of a spring, in a groove in a described sealing ring segment.

A turbine advantageously comprises such a stator.

Advantageously, the turbine is in this case designed as a gas turbine. It is precisely in gas turbines that the thermal, mechanical and dynamic loads are particularly high, and so the described configuration of the sealing ring segment affords particular advantages with regard to minimizing wear.

A power plant advantageously comprises such a turbine.

The advantages achieved with the invention consist in particular in that, as a result of the introduction of a disk spring construction for the defined fixed pretensioning of the sealing ring and guide vane, relative movements between the two parts are avoided. At the same time, in spite of the fixed pretensioning, thermal movability is ensured. With the described disk spring construction, desired tensioning between blades and sealing ring segments can be applied, this minimizing or reducing relative movement between the components in particular in the event of dynamic loads. Material wear can thus be reduced or avoided.

BRIEF DESCRIPTION OF THE DRAWINGS

An exemplary embodiment of the invention will be described in more detail with reference to a drawing, in which.

Identical parts are provided with the same reference signs in all figures.

DETAILED DESCRIPTION OF INVENTION

Figure 1:
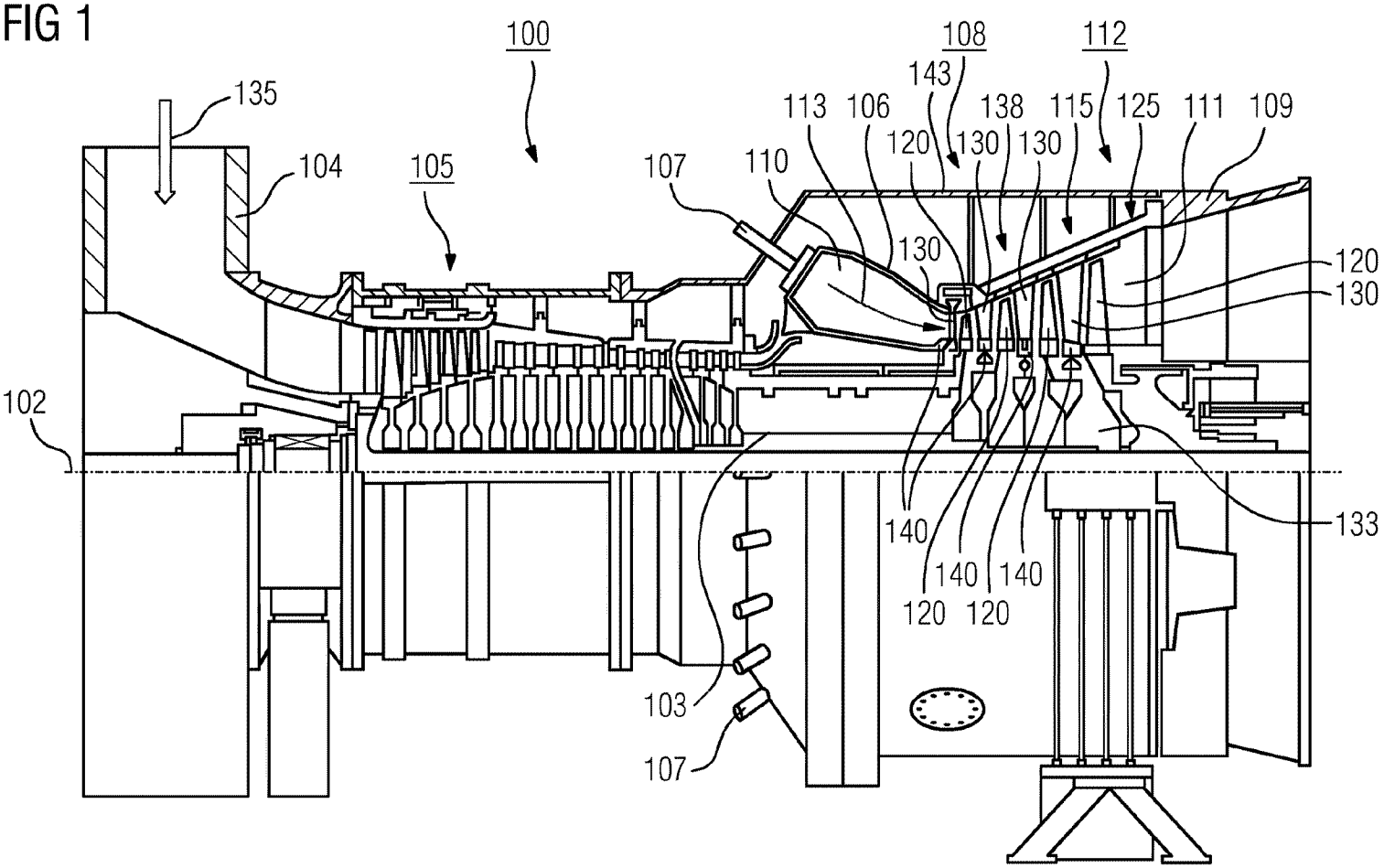
FIG. 1 shows a partial longitudinal section through a gas turbine having an annular combustion chamber.

FIG. 1 shows a turbine 100, here a gas turbine, in a longitudinal partial section. The gas turbine 100 has in its interior a rotor 103, also referred to as turbine rotor, that is mounted so as to rotate about a rotation axis 102 (axial direction). An intake housing 104, a compressor 105, a combustion chamber 110, illustrated here as an annular combustion chamber 106, having a plurality of coaxially arranged burners 107, a turbine 108 and the exhaust housing 109 follow one another along the rotor 103.

The combustion chamber 106 communicates with an annular hot-gas duct 111. For example, four turbine stages 112 are connected in series to form the turbine 108. Each turbine stage 112 is formed from two blade rings. As seen in the flow direction of a working medium 113, a ring 125 formed from rotor blades 120 follows a ring of guide vanes 115 in the hot-gas duct 111.

The guide vanes 130 are in this case fastened to the stator 143, whereas the rotor blades 120 of a ring 125 are attached to the rotor 103 by means of a turbine disk 133. The rotor blades 120 thus form constituent parts of the rotor 103. Coupled to the rotor 103 is a generator or working machine (not illustrated).

During operation of the gas turbine 100, the compressor 105 sucks in air 135 through the intake housing 104 and compresses it. The compressed air provided at the turbine-side end of the compressor 105 is passed to the burners 107, where it is mixed with a fuel. The mixture is then burnt in the combustion chamber 110, forming the hot and pressurized working medium 113. From there, the working medium 113 flows along the hot-gas duct 111 past the guide vanes 130 and the rotor blades 120. At the rotor blades 120, the working medium 113 is expanded in a pulse-transmitting manner, such that the rotor blades 120 drive the rotor 103 and the latter drives the working machine coupled to it.

During operation of the gas turbine 100, the components exposed to the hot working medium 113 are subject to thermal loads. The guide vanes 130 and rotor blades 120 of the first turbine stage 112 as seen in the direction of flow of the working medium 113, in addition to the heat shield elements lining the combustion chamber 106, are subject to the greatest thermal loads. In order to withstand the temperatures that prevail there, they are cooled by means of a coolant. Similarly, the blades 120, 130 can have coatings protecting against corrosion (MCrAlX; M=Fe, Co, Ni, rare earths) and heat (thermal insulation layer, for example $ZrO_2$, $Y_2O_4$—$ZrO_2$).

Each guide vane 130 has a guide-vane root (not illustrated here) facing the housing 138 of the turbine 108, and a guide-vane head opposite the guide-vane root. The guide-vane head faces the rotor 103 and is fixed in a sealing ring 140. Each sealing ring 140 of a turbine stage in this case encloses the shaft of the rotor 103. It is advantageously formed from ten similar sealing ring segments 144.

On account of the given tolerances in the mounting of the guide vanes 130 on the sealing ring 140, relative movements of the two components occur, and these can result in early wear and even damage to the gas turbine 100.

Figure 2:
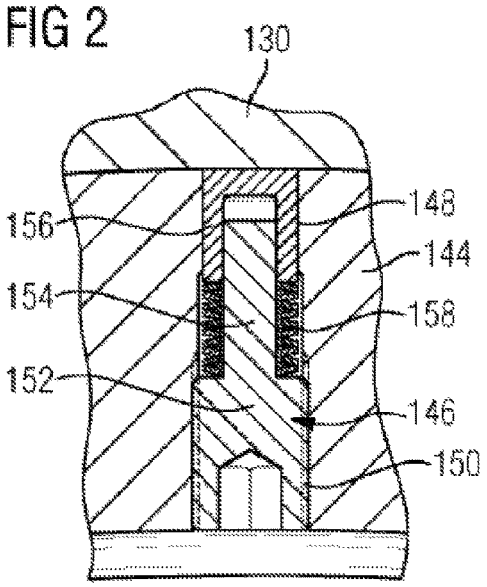
FIG. 2 shows a cross section through a pressure bolt.

Therefore, pressure bolts 146, which are shown in cross section in FIG. 2, are provided in the sealing ring segments 144. The pressure bolt 146 is fixed by screw connection in a through-bore 148, oriented in the radial direction, having a thread 150. The pressure bolt consists of a cylindrical portion 152 with a corresponding thread for screw connection with the sealing ring segment, a piston 154, adjoining the latter, with a smaller diameter, on which a capsule 156 that is movable in the axial direction of the pressure bolt 146 is seated, said capsule enclosing the piston 154 at its tip. As a result, it is fixed in a force-fitting manner in the radial direction of the pressure bolt 146.

A total of eight alternately arranged disk springs 158 are positioned in a manner enclosing the piston 154 between the portion 152 and capsule 156, said disk springs 158 exerting a restoring force upon axial compression of the pressure bolt 146. Since the pressure bolt 146 has been screwed into the sealing ring segment 144 in the radial direction with respect to the rotation axis of the gas turbine 102, it thus exerts a defined force on the hook connector of the guide vane 130, such that relative movements are prevented but thermal expansion remains possible. The restoring force can be set via the screw-in depth.

Figure 3:
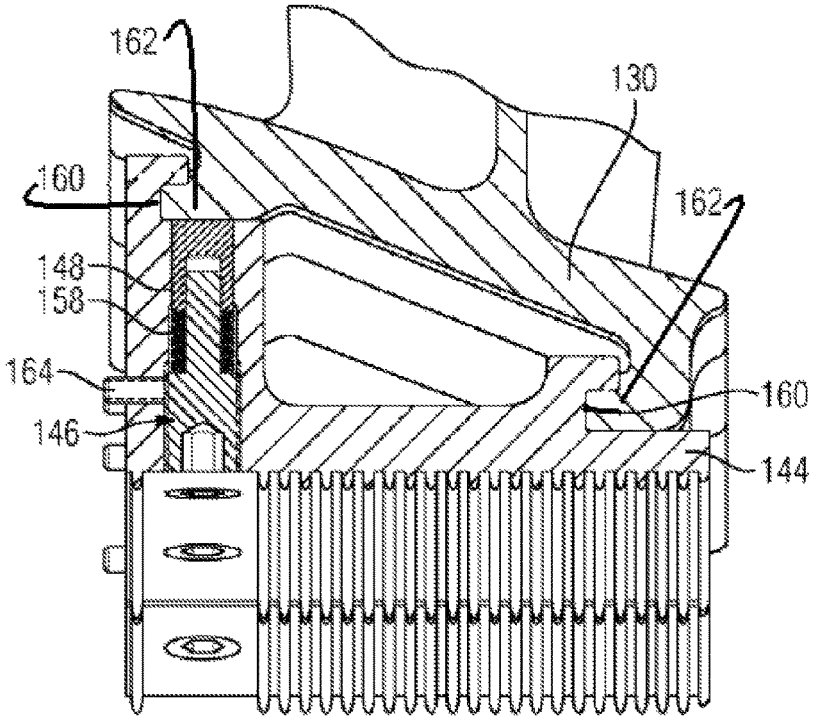
FIG. 3 shows a cross section through a sealing ring segment.

FIG. 3 shows a longitudinal section through the sealing ring segment 144. The sealing ring 144 has two grooves 160 that are spaced apart both axially and radially, extend in the circumferential direction and are open in each case in the same radial direction. Each groove 160 is in this case surrounded by a portion of the sealing ring segment 144 that is L-shaped in longitudinal section, the first leg of said portion extending in the radial direction and the second leg extending in the axial direction of the turbine 100. By way of corresponding circumferentially extending tongues 162 of the head of the guide vanes 130, which are arranged on the sealing ring segment 144 with a precise fit, the sealing ring segment 144 can thus be pushed onto the guide vane ring during mounting. The pressure bolt 146 is in this case arranged in the region of the radially outer groove 160 such that the capsule 156 opens into an opening in the radially inner wall of the groove 160. Since the pressure bolt 146 exerts a radial restoring force which acts on the tongue 162 in the groove 160, the tongue 162 is thus pressed in the groove 160 against the radially oriented legs of the L-shaped part of the sealing ring segment 144. The guide vane 130 is thus fixed elastically in the grooves 160.

The pressure bolt 146 is secured against rotation by means of a bolt 164. The bolt 164 is introduced through an axially extending bore which meets the bore 148 in the pressure bolt 146 and screwed together therewith. As a result, it exerts a lateral force on the thread of the pressure bolt 146 and fixes the latter in a force-fitting manner.

Figure 4:
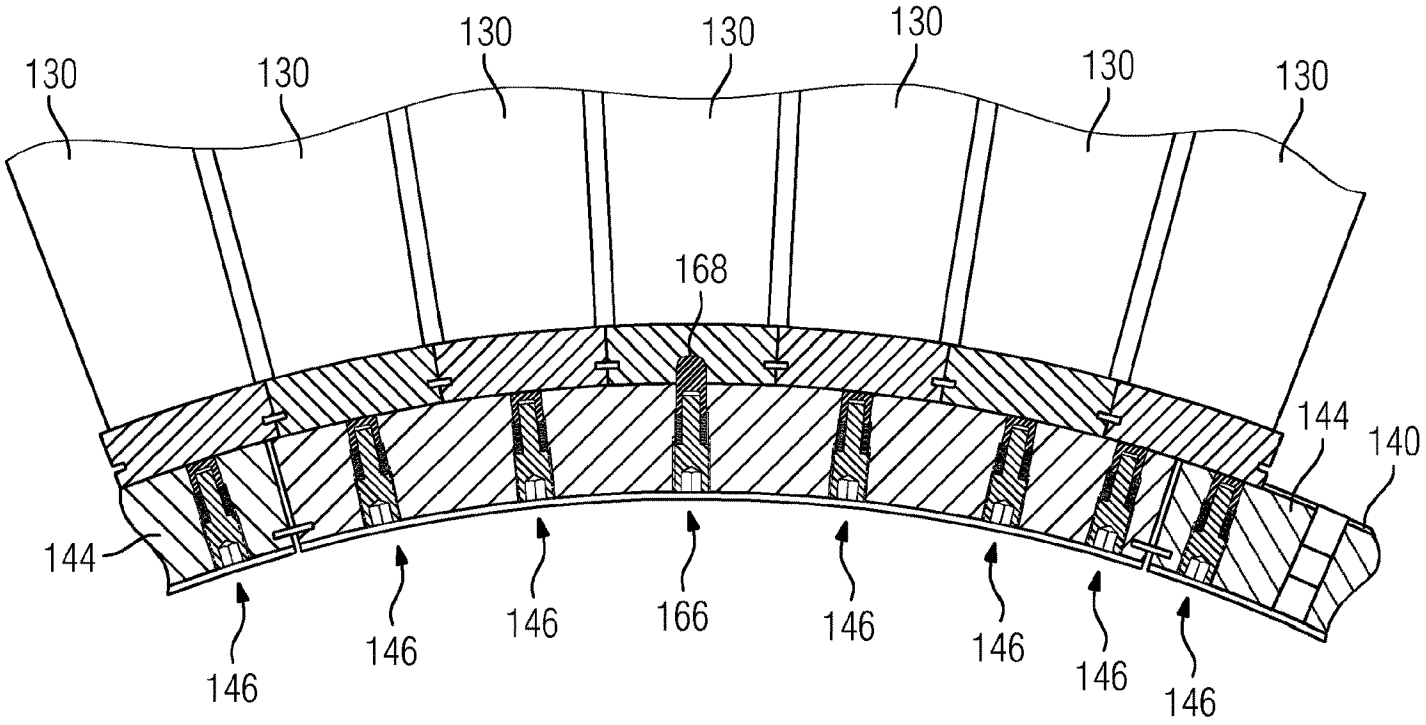
FIG. 4 shows a section through the sealing ring segment.

Finally, FIG. 4 shows a partial section through the sealing ring 140 and the sealing ring segments 144. The pressure bolts 146 exert, as described, a restoring force on the guide vanes 130. One of the pressure bolts 146 is additionally designed as a circumferential fixing bolt 166. It is longer than the other pressure bolts 146 and projects into a depression 168, formed therefor, in a root of a guide vane 130. As a result, the sealing ring segment 144 is fixed to the guide vane 130 in the circumferential direction.

The invention claimed is:

1. A sealing ring segment for a stator of a turbine, wherein the sealing ring segment has substantially the shape of a cylinder segment, the sealing ring segment comprising:

a groove on an outer side of the sealing ring segment for fixing a plurality of guide vanes, at least one pressure bolt is configured to act with a restoring force on each guide vane of the plurality of guide vanes that can be fixed on the sealing ring segment, wherein said at least one pressure bolt is adapted to be fixed and accordingly oriented by a corresponding opening in the sealing ring segment and comprising a cylindrical element which can be compressed in an axial direction of the at least one pressure bolt, and wherein the at least one pressure bolt comprises a disk spring and the restoring force of the at least one pressure bolt acts in a radial direction with respect to a rotation axis of the turbine in which the sealing ring segment is placed;

wherein the at least one pressure bolt includes a piston adjoining the cylindrical element and wherein the piston has a smaller diameter than the cylindrical element.

2. The sealing ring segment as claimed in claim 1, wherein the groove extends in a circumferential direction with respect to the rotation axis of the turbine in which the sealing ring segment is placed.

3. The sealing ring segment as claimed in claim 1, wherein the at least one pressure bolt is fixed to the sealing ring segment by a screw connection.

4. The sealing ring segment as claimed in claim 3, wherein the corresponding opening in the sealing ring segment includes a thread and wherein the cylindrical element of the at least one pressure bolt includes a corresponding thread to form the screw connection with the thread of the corresponding opening.

5. The sealing ring segment as claimed in claim 1, wherein the disk spring is configured to exert the restoring force when the at least one pressure bolt is compressed in the axial direction of the at least one pressure bolt.

6. The sealing ring segment as claimed in claim 1, wherein the disk spring is positioned in a manner enclosing the piston.

7. The sealing ring segment as claimed in claim 1, wherein the at least one pressure bolt includes at least one first pressure bolt and at least one second pressure bolt, wherein the at least one second pressure bolt is longer than the at least one first pressure bolt.

8. A stator for a turbine, comprising:

a number of guide vanes, wherein a plurality of the guide vanes are arranged at their radially inwardly directed root, by a tongue, in a groove in a sealing ring segment as claimed in claim 1.

9. The stator as claimed in claim 8, wherein the at least one pressure bolt is arranged such that the at least one pressure bolt fixes a respective guide vane of the plurality of the guide vanes in a force-fitting manner in a circumferential direction with respect to the rotation axis of the turbine in which the sealing ring segment is placed.

10. The stator as claimed in claim 8, wherein the at least one pressure bolt fixed in the sealing ring segment is configured to prevent relative movement between the sealing ring segment and the plurality of the guide vanes.

11. A turbine, comprising:

a stator as claimed in claim 8.

12. The turbine as claimed in claim 11, wherein the turbine comprises a gas turbine.

13. A power plant, comprising:

a turbine as claimed in claim 11.

14. A sealing ring segment for a stator of a turbine, wherein the sealing ring segment has substantially the shape of a cylinder segment, the sealing ring segment comprising:

a groove on an outer side of the sealing ring segment for fixing a plurality of guide vanes, at least one pressure bolt is configured to act with a restoring force on each guide vane of the plurality of guide vanes that can be fixed on the sealing ring segment, and a capsule enclosing a tip of the at least one pressure bolt, wherein the capsule is movable in an axial direction of the at least one pressure bolt, wherein said at least one pressure bolt is adapted to be fixed and accordingly oriented by a corresponding opening in the sealing ring segment and comprising a cylindrical element which can be compressed in the axial direction of the at least one pressure bolt, and wherein the at least one pressure bolt comprises a disk spring and the restoring force of the at least one pressure bolt acts in a radial direction with respect to a rotation axis of the turbine in which the sealing ring segment is placed.

15. The sealing ring segment as claimed in claim 14, wherein the at least one pressure bolt is arranged such that the capsule opens into an opening in a radially inner wall of the groove of the sealing ring segment.

16. The sealing ring segment as claimed in claim 14, wherein the disk spring is positioned in a manner enclosing the at least one pressure bolt between the cylindrical element and the capsule.

17. A stator for a turbine, comprising:

a number of guide vanes;

wherein a plurality of the guide vanes are arranged at their radially inwardly directed root, by a tongue, in a groove on an outer side of a sealing ring segment for fixing the plurality of the guide vanes, said sealing ring segment comprising:

at least one pressure bolt that is configured to act on each of the plurality of the guide vanes by a restoring force, wherein said at least one pressure bolt is adapted to be fixed and accordingly oriented by a corresponding opening in the sealing ring segment and comprising a cylindrical element which can be compressed in an axial direction of the at least one pressure bolt, and wherein the at least one pressure bolt comprises a disk spring and the restoring force of the at least one pressure bolt acts in a radial direction with respect to a rotation axis of the turbine in which the sealing ring segment is placed;

wherein the at least one pressure bolt includes a piston adjoining the cylindrical element and wherein the piston has a smaller diameter than the cylindrical element; and wherein the disk spring is positioned in a manner enclosing the piston.

* * * * *